US005878824A

United States Patent [19]

Mercer et al.

[11] Patent Number: 5,878,824

[45] Date of Patent: Mar. 9, 1999

[54] BORING TOOL OR OTHER DEVICE INCLUDING THERMAL PROTECTION FOR AN ELECTRONIC COMPONENT ASSEMBLY AND METHOD

[75] Inventors: John E. Mercer, Kent; Rudolf Zeller, Renton; Shiu Sang Ng, Kirkland, all of Wash.

[73] Assignee: Digital Control Incorporated, Renton, Wash.

[21] Appl. No.: 757,831

[22] Filed: Nov. 27, 1996

[51] Int. Cl.[6] ..... E21B 44/00; E21B 47/00

[52] U.S. Cl. ..... 175/24; 175/40

[58] Field of Search ..... 175/24, 40; 166/250.01, 166/53, 66

[56] References Cited

U.S. PATENT DOCUMENTS

| | | | |
|---|---|---|---|
| 4,203,087 | 5/1980 | Kovac et al. | 338/35 |
| 4,606,415 | 8/1986 | Gray, Jr. et al. | 175/24 |
| 4,646,277 | 2/1987 | Bridges et al. | 175/24 |
| 4,990,987 | 2/1991 | Boucher et al. | 357/28 |
| 5,337,002 | 8/1994 | Mercer | 324/326 |

*Primary Examiner*—Hoang C. Dang
*Attorney, Agent, or Firm*—Steve Shear; Mike Pritzkau

[57] ABSTRACT

An arrangement and associated method for thermally protecting an electronic component assembly from heat at least to a limited extent is disclosed herein. The electronic component assembly includes a plurality of thermally sensitive electronic devices, each of which is constructed such that when the device is in a powered state there is a maximum operating temperature to which it may be subjected without causing thermal damage and such that when the device is in a non-powered state there is a higher maximum non-operating temperature to which the device may be subjected without causing thermal damage. During powered operation of the assembly, the temperature is sensed at a predetermined position in close proximity to the devices. When the sensed temperature reaches the maximum operating temperature, operational power is disconnected from the electronic component assembly such that the temperature of the electronic component assembly may rise in an unpowered state to a maximum overall non-operating temperature without thermally damaging the devices. While the invention has specific application to a boring tool, it is adaptable for use in other high temperature environments.

38 Claims, 3 Drawing Sheets

BORING TOOL OR OTHER DEVICE INCLUDING THERMAL PROTECTION FOR AN ELECTRONIC COMPONENT ASSEMBLY AND METHOD

BACKGROUND OF THE INVENTION

The present invention relates generally to a boring tool or other device including thermal protection for an electronic component assembly and more particularly to an arrangement for thermally protecting the electronic component assembly by sensing temperature at a predetermined position relative to the assembly and disconnecting operational power therefrom when the sensed temperature reaches a maximum operating temperature such that the assembly may then survive in an unpowered state up to a higher maximum non-operating or storage temperature.

The use of horizontal boring tools has become increasingly popular. One contributing factor is the ever increasing underground installation of utility lines for reasons of aesthetics and for practical reasons such as, for example, protecting these lines from the effects of severe above ground weather conditions. In many cases it is undesirable to excavate an entire pathway for the purpose of installing such underground lines. For example, in areas where buried lines have previously been installed, such excavation many times results in the unintentional damage of an existing utility line. Therefore, boring tools may be utilized to avoid extensive excavation whereby to avoid unintentional damage to existing lines. Moreover, as guidance systems for horizontal boring tools become more and more sophisticated, the operator of a boring tool may avoid contact with such existing utility lines during a drilling operation by steering the tool around the line as it is approached.

It should be appreciated, however, that the increased sophistication of state of the art boring tools is attributable at least in part to the use of increasingly sophisticated electronic components which are positioned in the drill head of the boring tool. Typically, an electronic package in the drill head senses positional/orientation information relating to the underground guidance of the boring tool and transmits locating information to the surface using a telemetry transmitter. The package, like most other electronic assemblies, is sensitive to various environmental conditions including heat. Such heat may be produced by components which form part of the assembly and/or, as a result of the underground operation of the boring tool, as will be described immediately hereinafter.

During a particular boring operation, various underground soil conditions may be encountered by the boring tool including, for example, highly compacted soils or rock. When such a condition is encountered, significant frictional heat may rapidly be produced by interaction of the boring tool with the ground. This heat may cause the temperature of the boring tool to rise by hundreds of degrees in a time period less than one minute depending, of course, on how problematic the soil is. The electronic package housed in the drill head is then subjected to this heat in conjunction with its internally generated heat. In the past, there have been temperature sensing arrangements which, upon sensing a predetermined temperature, attempted to cope with this heat by shutting down only power to the output stage of the transmitter which drives the antenna housed in the drill head. However, protection offered to the electronic package by this arrangement was limited in that the rest of the system remained operational. Thus, there continues to be a need for improved thermal protection for electronic packages in boring tools and other devices.

As will be seen hereinafter, the present invention provides a highly advantageous arrangement and associated method for effectively providing an added margin of thermal protection for an electronic package within a boring tool or other devices including electronic packages which are subjected to similar thermal concerns.

SUMMARY OF THE INVENTION

As will be described in more detail hereinafter, there is disclosed herein a heat protected boring tool and associated method. The heat protected boring tool includes an electronic component assembly which itself includes a plurality of thermally sensitive electronic devices. Each device is constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage. The boring tool further includes means for providing operational power to the assembly including the devices and sensing means for sensing the temperature at a predetermined position in close proximity to the devices. Further, the boring tool provides disconnecting means for disconnecting the operational power from the assembly when the sensed temperature reaches the maximum operating temperature such that the heat may cause the temperature of the assembly in an unpowered state to rise to a maximum overall non-operating temperature without thermally damaging the devices within the assembly due to the heat.

In one aspect of the invention, thermal protection and its associated method, as disclosed herein, may readily be adapted for use in protecting other devices which include electronic packages.

BRIEF DESCRIPTION OF THE DRAWINGS

The present invention may be understood by reference to the following detailed description taken in conjunction with the drawings, in which.

DETAILED DESCRIPTION OF THE INVENTION

Figure 1:
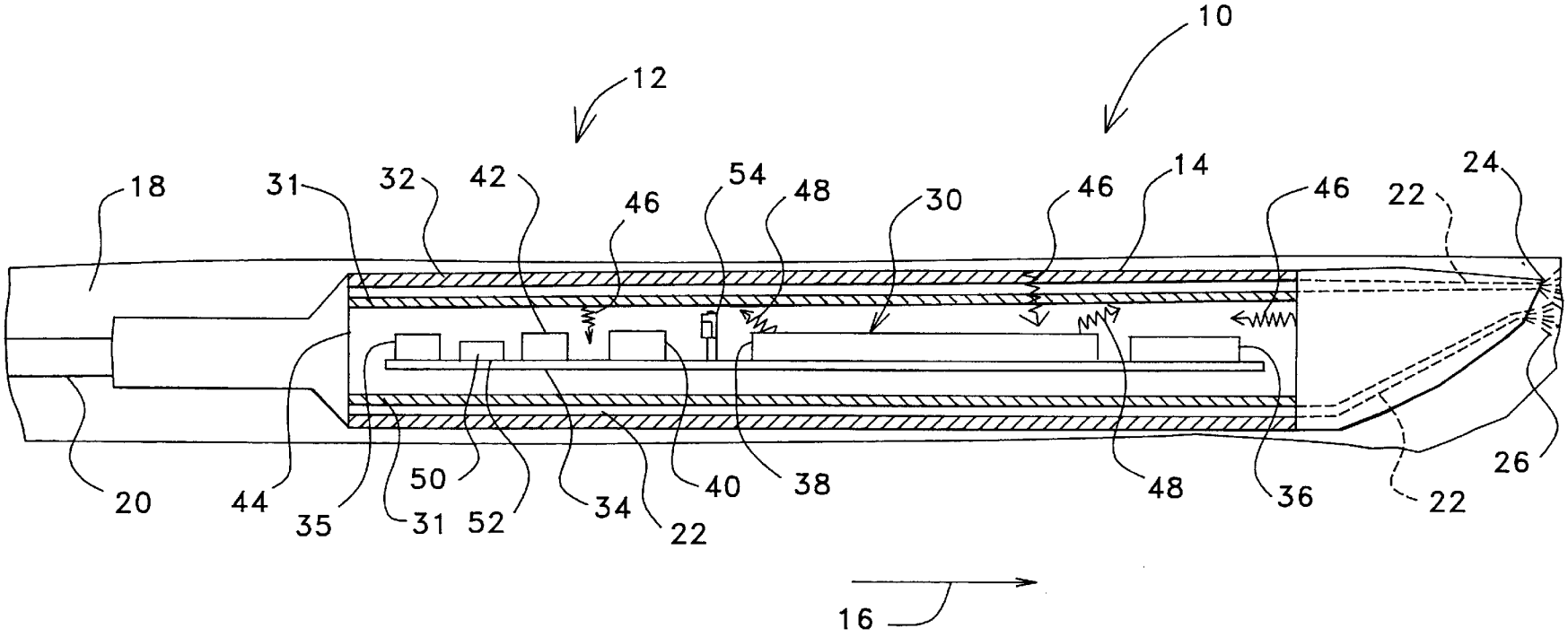
FIG. 1 is a diagrammatic cross-sectional view, in elevation, of a boring tool during operation in an underground region and including a thermal protection arrangement for protecting an electronic component assembly in accordance with the present invention.

Attention is immediately directed to FIG. 1 which is a diagrammatic cross-sectional view of a boring tool, generally indicated by the reference numeral 10, in use during a typical boring operation being performed in an underground region 12. Boring tool 10 moves a drill head 14 in a direction which is indicated by arrow 16 to form an underground bore 18. Drill head 14 is carried by a drill string 20 which extends to the surface at the origination point of bore 18 where an operator station (not shown for purposes of simplicity) is located.

Still referring to FIG. 1, boring tool 10 also includes a plurality of fluid passages 22 which lead to high pressure jets 24 positioned at the front of drill head 14. Jets 24 emit a fluid 26 which is pumped down drill string 20 from the operator station. A wide variety of different liquids and material may be used in fluid 26. In many cases, a viscous mud-like material is utilized. The mud may contain water mixed with clays and/or polymers. Such mud serves not only to cut away the soil in front of the boring tool but also to lubricate the boring tool as the mud flows in a direction opposite that of the movement of the boring tool and to provide cooling during the boring operation. Additionally, soil particles and rock flakes dislodged by the boring tool are suspended in the viscous mud and are, thereafter, carried out of bore 18 to the surface. Fluid 26 may contain liquids other than water. For example, propylene glycol may be added to the fluid during wintertime operation so as to avoid problems caused by fluid 26 freezing in the bore.

Boring tool 10 also includes an electronic component assembly 30 which is housed in a tube 31 inserted into a relatively heavy surrounding steel casing 32 which forms part of drill head 14. Electronic component assembly 30 includes a printed circuit board 34 upon which a number of functional circuit sections or modules are arranged including a battery 35, a position sensor section 36, an antenna 38 (which is generally insensitive to heat), a processor/driver section 40 and a step-up regulated switching power supply 42. These circuit sections will not be described in detail herein for purposes of brevity since similarly configured circuitry is known in the art. The interested reader is referred to U.S. Pat. No. 5,337,002, which is incorporated herein by reference and which is assigned to the assignee of the present invention, for further details. Typically, printed circuit board 34 and its associated modules are sealed within a heat resistant potting compound 44 of a type which is known in the art and which is injected into the interior of tube 31. The latter is normally configured to be removable from steel casing 32 so as to facilitate replacement of battery 35 and/or replacement of the entire electronic package. In the present example, potting compound 44 is illustrated as being transparent for purposes of illustration. The potting compound serves to provide mechanical shock protection for the electronics as well as providing a barrier against external contaminants such as, for example, fluid 26. It should also be noted that steel casing 32 is configured having a plurality of slots (not shown for purposes of clarity) adjacent antenna 30 which permit radiation to escape from the antenna into the surrounding environment. As noted previously, electronic component assembly 30 may be exposed to high temperature levels during operation of the boring tool. This heat exposure raises concerns which will become evident in the following discussion.

At this juncture, it is worthwhile to provide a discussion concerning factors which govern the survival of electronic components that are exposed to high temperatures in view of manufacturers thermal specifications. Typically, electronic manufacturers specify a maximum operating temperature which forms an upper limit within an operating temperature range. For many devices, this maximum operating temperature is approximately 80° C. In addition, manufacturers specify a maximum storage temperature for the device at which it may safely be stored. While variations exist in the specified maximum non-operating or storage temperature for different devices, this temperature is near 120° C. for many devices. The manufacturer's concern in specifying either of these temperatures stems from a desire to prevent failure of one or more semiconductor junctions within the device. In fact, such junctions will typically fail when the junction is locally exposed to a temperature above the specified maximum non-operating temperature or storage temperature, regardless of whether or not the device is operating or the actual source of the heat. Therefore, the maximum non-operating temperature is actually the highest temperature to which the device's semiconductor junctions may be exposed without thermal damage. Of course, when the ambient temperature surrounding the non-operating device is at the storage temperature, the temperature of the entire device including its junctions will rise to the storage temperature. Further temperature increases may precipitate thermal damage. When the device is operating, internally generated heat should be considered, as will be described immediately hereinafter.

The reasoning behind manufacturers specifying a maximum operating temperature which is lower than the maximum non-operating temperature is directly related to internal heat generation during operation of a device. Such internally generated heat is typically conducted away from the device junctions by an encapsulant material or by a heat sink and is dissipated into the ambient environment. Thus, the maximum operating temperature is an ambient temperature, rather than a junction temperature. More specifically, it is the highest ambient temperature at which the operational device is capable of carrying sufficient heat away from the junction and, thereafter, dissipating this heat into the ambient environment such that the junction temperature does not exceed the maximum non-operating or storage temperature. Some devices such as, for example, voltage regulators incorporate monitoring circuitry which locally monitors junction temperature within the device and which shuts the device down once the junction temperature reaches the maximum storage temperature, since junction failure is eminent with further increases in temperature. Thus, junction monitoring relies on the ability of the device to continuously and immediately dissipate heat away from the junction and into the ambient environment once the device is shut down so as to eliminate internal heat production and prevent further increases in the junction temperature. However, in the environment contemplated by the present invention, sudden and extreme amounts of heat may be generated surrounding the device in the drilling operation such that heat flows into rather than away from the junctions, eliminating the normal ability of the device to dissipate heat away from the junction.

If the junction is already operating at or near its maximum storage temperature, sudden heat input from drilling may, consequently, raise the junction above the maximum storage temperature, resulting in device failure. This may occur even in devices which employ junction monitoring since shutdown may fail to alleviate further temperature increases. Moreover, many solid state devices, such as, for example integrated circuits and small signal transistors do not typically employ internal thermal protection and are at risk in any high temperature environment. As will be seen hereinafter, the present invention provides a highly effective, reliable method for enhancing the survival of an assembly of electronic devices up to an overall maximum storage temperature in a thermal environment which may include heat contributed by the surroundings of the assembly and/or generated internally within the assembly. This method has particular application in thermally protecting an electronic package assembly housed in the drill head of a boring tool.

With regard to significant heat sources in the operation of the boring tool of FIG. 1 and as previously mentioned, a frictional contribution 46 of heat may be generated as a result of the boring operation itself, specifically due to friction between drill head 14 and its immediate surroundings within area 12 including highly compacted soils or rock. Frictional heat contribution 46 is conducted from steel drill casing 32 through potting compound 44 and ultimately to electronic component assembly 30 and may, in and by itself, cause the temperature of the boring tool to rise rapidly. An internal contribution 48 of significant heat may be produced by certain components of the electronic component assembly itself. For example, one of skill in the art will appreciate that radio frequency (RF) transmitter 38 as well as its associated driving circuitry in processing/driver section 40 may generate relatively large amounts of this internal contribution 48 of heat, depending upon the output power and losses of the transmitter. The combination of heat generated by the assembly with the aforementioned frictional heat, generated by movement of the boring tool, may subject the electronic assembly to temperatures which may increase at a rapid rate, leading to thermal failure.

Referring once again to FIG. 1, fluid 26 affords some protection for electronic component assembly 30 against heat contributions 46 and 48. In fact, as the temperature of drill head 14 rises, the constituents which make up fluid 26 may become significant in that portions of certain liquid components of the fluid may boil, that is, be converted to their vapor phase as they travel along the drill head after being emitted in a forward direction from jets 24 of the drill head. It should be appreciated that conversion of a liquid such as, for example, water from its liquid phase to its vapor or steam phase may absorb a great deal of the heat generated by the drill head. At the same time, however, it is important to understand that, with regard to electronic components, the boiling point of water (100° C.) is a temperature which lies well above a specified maximum operating temperature, typically 80° C., for most electronic components. Therefore, while high temperature tolerant components of the drill head, such as casing 32 may be protected by this cooling, electronic component assembly 30 remains at risk. Moreover, fluid jets 26 being used as the cooling system of the boring tool is subject to possible failure. As one example, jets 24 may either partially or completely clog leading to reduced or no cooling from fluid 26. Another limitation is encountered when the output of fluid 26 is simply insufficient to overcome the thermal intensity from the frictionally produced contribution of heat. As will be seen hereinafter, the present invention provides circuitry and an associated method which cooperates with the cooling system of the boring tool in a highly advantageous way and which effectively protects the electronic component assembly up to a maximum overall non-operating temperature which may significantly exceed the boiling point of fluid 26.

Figure 5:
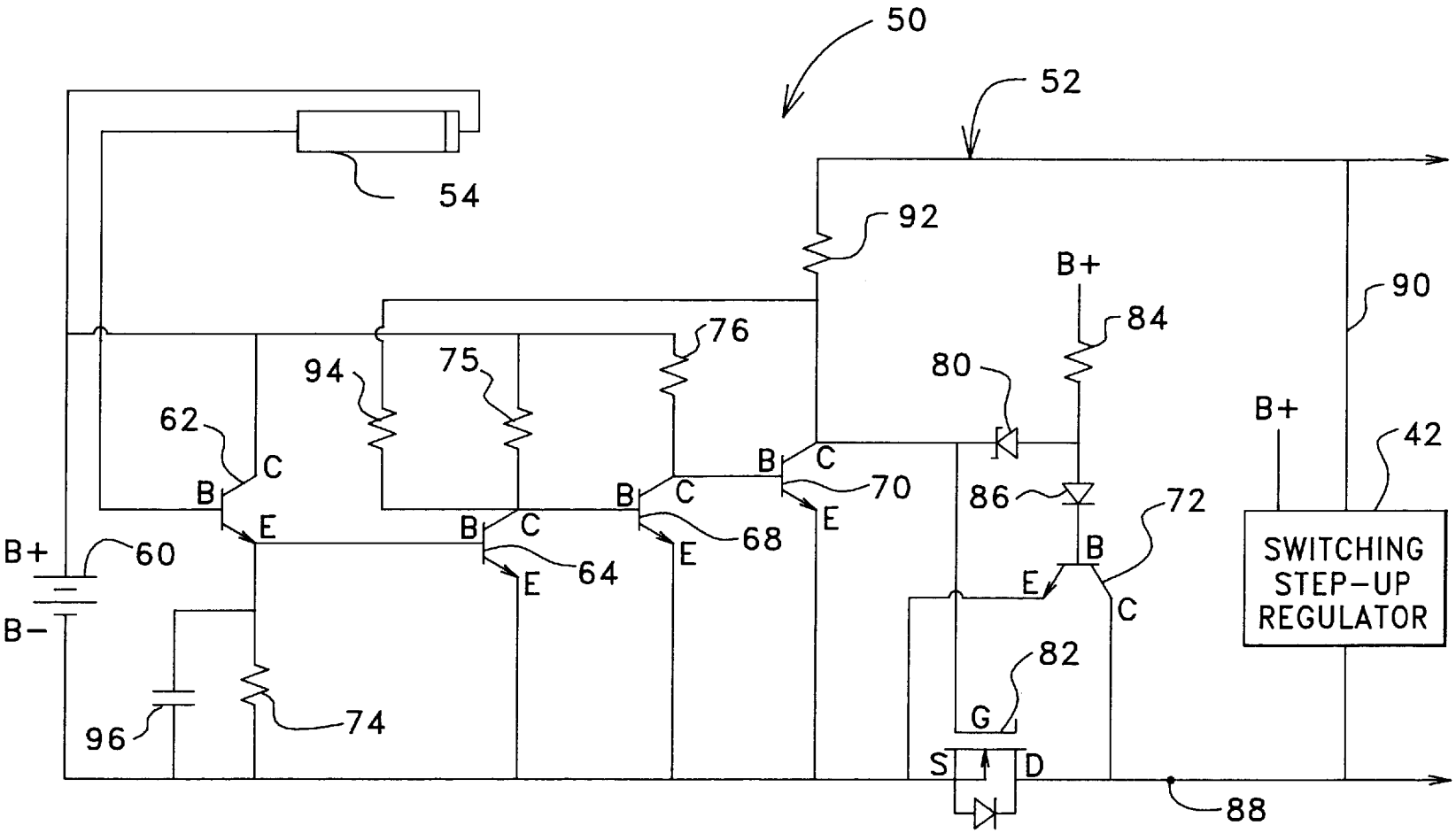
FIG. 5 is a schematic diagram illustrating a sensing circuit which is positioned in the boring tools of FIGS. 1–4 for connection with each of the temperature sensing diodes.

Referring to FIG. 5 in conjunction with FIG. 1 and in accordance with the present invention, a temperature sensor arrangement 50 is positioned on printed circuit board 34 along with those assemblies described above. Temperature sensor arrangement 50 includes a sensing circuit 52, which is schematically illustrated in FIG. 5, and a thermally sensitive device such as a diode 54. Sensing circuit 52 will be described in detail at an appropriate point below. For the moment it is noted that temperature measurement may be performed by monitoring the leakage current of diode 54 when the diode is held in a reverse biased state. As will be seen hereinafter, diode 54 may be positioned at any desired point on or in proximity with printed circuit board 34 with regard to specific heat monitoring objectives.

In the example of FIG. 1, diode 54 is positioned immediately between antenna 38 and processor/driver section 40, which includes the driving circuitry that provides (RF) power to antenna 38, with the objective of receiving a combination of frictional heat contribution 46 from case 32 of the drill head and internal heat contribution 48 from either antenna 38 or its driving circuitry. So long as the sensed temperature at the location of diode 54 remains below a predetermined maximum overall operating temperature, sensing circuit provides operational power to all the circuitry on printed circuit board 34. However and in accordance with the present invention, if the sensed temperature at diode 54 rises to and/or above the predetermined maximum operating temperature, sensing circuit 52 disconnects operational power from all other components on printed circuit board 34. Components which make up position sensor section 36, processor/driver section 40 and regulator 42 may then survive further temperature increases up to their respective maximum non-operating or storage temperatures. Typically, sensing circuit 52 will be configured to shut down power at a predetermined, sensed temperature of approximately 80° C. This temperature provides for a highly advantageous margin of safety of approximately 40° C. in that many assemblies may be permitted to rise to 120° C. in a non-operating state.

In the event that frictional heat contribution 46 remains at a sufficient level to continue to raise the temperature of the electronic component assembly, in spite of shutdown of substantially all significant heat producing components therein, the temperature of the drill head will eventually reach the boiling point of liquid constituents within fluid 26. In the case where fluid 26 includes water, the drill head will reach 100° C. at which point the previously described vaporization of this water may potentially extract high levels of heat from the drill head. It is important to understand that the boiling point of liquids which are useful in the present invention should reside in the temperature range between the maximum operating temperature (~80° C.) and the maximum non-operating temperature (~120° C.) of the electronic component assembly being protected in order to fully achieve all of the advantages taught by the present invention. The use of water in fluid 26 generally meets this requirement. As noted previously, 100° C. is well above the typical maximum operating temperature of most electronic devices. Accordingly, allowing an electronic component assembly to operate at the boiling point of water is likely to result in its failure. However, the assembly may be subjected to this temperature for a substantially unlimited period of time in a non-operating state in accordance with the method of the present invention.

In the specific application of a boring tool, the temperature monitoring configuration of the present invention is coupled with heat extraction by vaporization to provide a significant advantage resulting in an additional margin of thermal protection for the electronic component assembly. When all the advantages of the present invention are fully appreciated, the boring tool may be operated in such a way that the possibility of thermal damage to the electronic assembly is all but eliminated. For example, the operator of boring tool 10 will be apprised that the shutdown circuit is in its shutdown mode and that the potential exists for overheating the boring tool by the simple fact that transmission of telemetry information from the boring tool to the surface ceases. At this point, the operator may stop drilling while continuing to inject fluid 26 down drill string 20 whereby to allow the drill head to cool down. In this way, the operator runs very little risk of overheating electronic component assembly 30. Once the sensed temperature falls to or below the maximum operating temperature, sensing circuit 52 automatically restores power to the overall electronic component assembly such that transmission of telemetry information resumes. The operator may then safely resume drilling.

Figure 2:
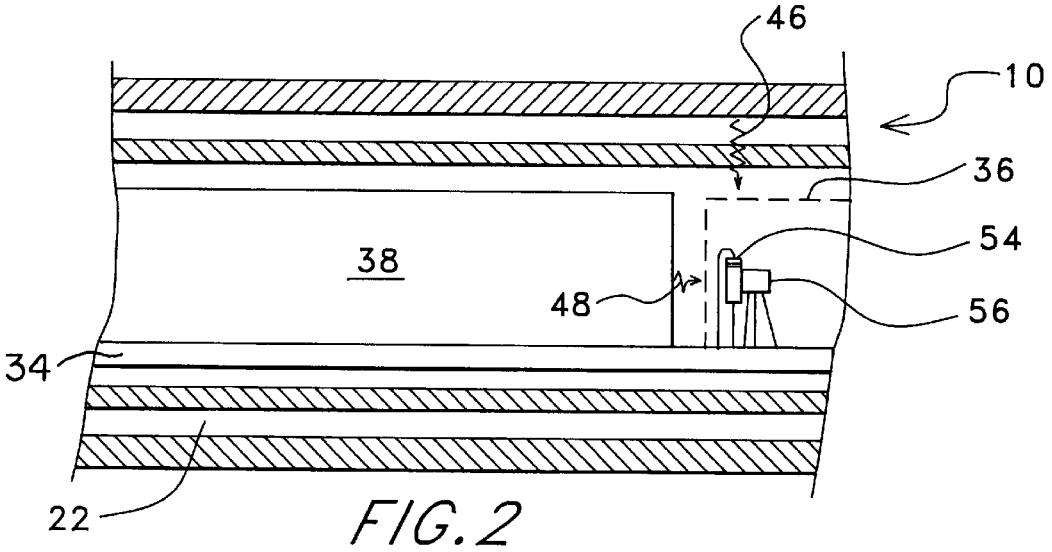
FIG. 2 is a diagrammatic cross-sectional view, in elevation, of a portion of a boring tool showing a temperature sensing diode adjacent to a transistor which is exposed to significant levels of heat generated internal to the boring tool.

Referring to FIG. 2, diode 54 is shown at a second position illustrative of another objective with regard to thermal protection. In this second position, diode 54 is positioned directly adjacent to a transistor 56 which, for example, may comprise one component of positioning sensor section 36 and which is in close proximity to antenna 38. As previously discussed, antenna 38 may generate considerable heat at high power levels. Even though transistor 56 may include relatively high thermal ratings, additional protection may be required in situations such as that of the present example where this particular component is exposed to higher temperature levels than much of the remaining circuitry. In accordance with the present invention, a component such as transistor 56 is protected from exposure to the antenna generated contribution of heat 48 by monitoring the temperature immediately adjacent to or at the location of the transistor or similar such component. To that end, diode 54 is positioned adjacent to the transistor and, even more preferably, between the component being protected and the source of the heat. At this position, diode 54 also receives frictional heat contribution 46 from the case of drill head 14 such that frictional heat may also contribute to the sensed temperature. The arrangement of the present example is useful in situations where a particular component within an assembly experiences repeated thermal failures during operation even when the rest of the assembly is thermally unaffected.

Figure 3:
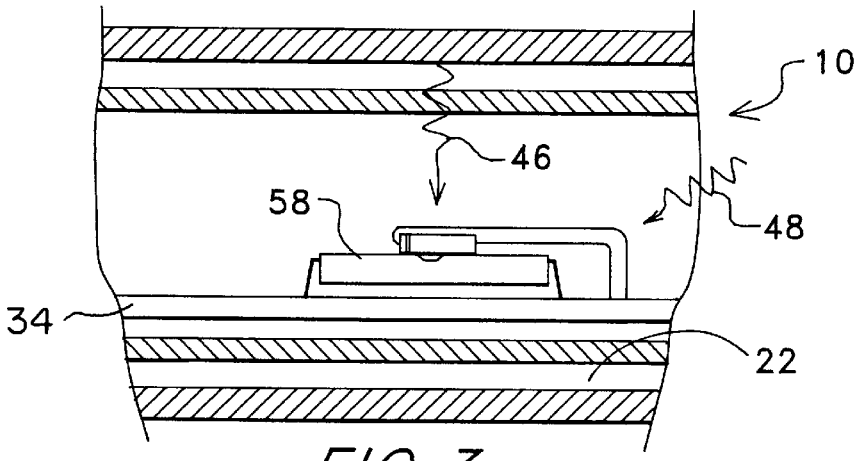
FIG. 3 is a diagrammatic cross-sectional view, in elevation, of a portion of a boring tool showing a temperature sensing diode adjacent to an integrated circuit which is relatively sensitive to thermal energy.

Referring to FIG. 3, diode 54 is shown at a third position illustrative of still another objective with regard to thermal protection. More specifically, providing thermal protection for electronic components having low thermal ratings relative to other components. In this third position, diode 54 is positioned directly adjacent to or in physical contact with an integrated circuit (IC) 58 which may, for example, comprise part of processor/driver section 40 and which may be the most thermally sensitive component upon printed circuit board 34. This arrangement produces a sensed temperature at IC 58 which includes components of the frictional and internal contributions of heat 46 and 48, respectively. Moreover, sensing circuit 52 may be configured for shutting down the overall electronic component assembly specifically based upon the thermal characteristics of IC 58. For example, if the maximum operating temperature of IC 58 happens to be 70° C., sensor circuit 52 may be set to shut down at or slightly above this temperature in a way which will be described at an appropriate point below.

Figure 4:
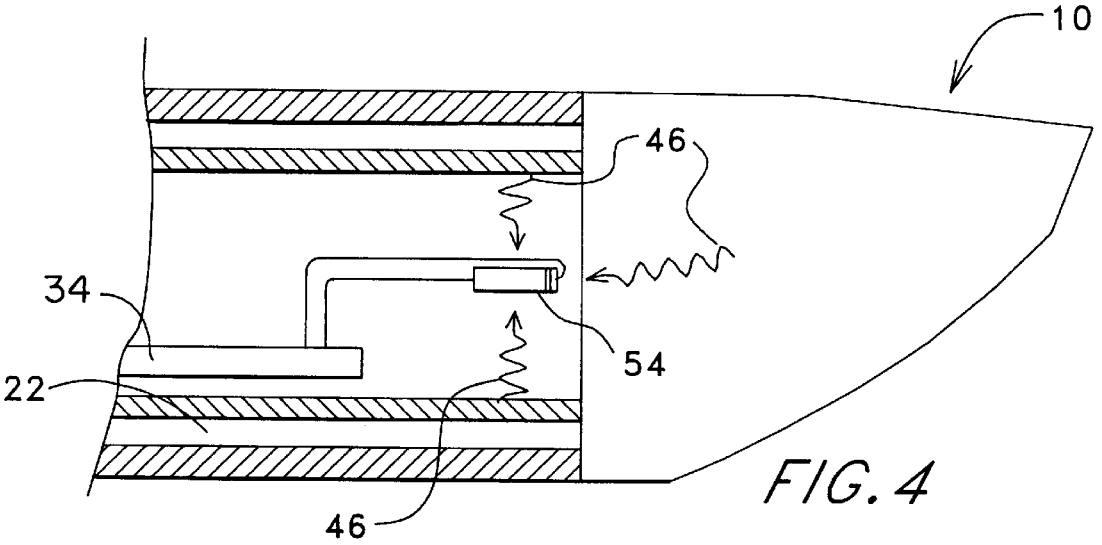
FIG. 4 is a diagrammatic cross-sectional view, in elevation, of a forward portion of a boring tool showing a temperature sensing diode positioned for sensing frictional heat generated by relative movement between the boring tool and the ground.

Referring to FIG. 4, diode 54 is shown at a fourth position illustrative of yet another objective with regard to thermal protection. More specifically, the arrangement of FIG. 4 positions diode 54 immediately ahead of printed circuit board 34 since this is typically the hottest available monitoring point in proximity to the assembly with regard to frictional heat. This arrangement is useful in difficult drilling situations where a great deal of frictional heat is expected or in situations where very little heat is generated internally to the electronic component assembly, for example, in instances of low power level transmission from antenna 38.

It should be appreciated that all of the positional arrangements of diode 54 described above are readily accomplished using as an electrical interconnection arrangement between the diode and the rest of circuit 52 suitable conductive traces on printed circuit board 34. These arrangements are also readily accomplished using other interconnection techniques which may, for example, employ a substrate or in which components are suspended in potting compound and directly electrically interconnected.

In one embodiment, multiple sensor arrangements may be employed in which more than one of the aforedescribed positional arrangements is utilized. This embodiment is particularly useful under different types of operational conditions which cause different heating patterns with respect to the drill head. As one example, drilling against rock may cause the tapered leading portion of the drill head to be hot relative to the rest of the drill head. As another example, drilling through sand may shift the highest levels of generated heat to drill casing 32 due to friction of the sand against the casing. By simultaneously sensing at both the tapered leading portion of the drill head and at a point, for example, as illustrated in FIG. 1, the electronic package can advantageously be protected from the effects of localized heat production due to varying operational conditions.

Attention is now directed to FIG. 5 which illustrates details of sensing circuit 52. The latter includes a battery 60 having B+ and B− terminals and providing approximately 3 volts in its charged state. The circuit includes five bipolar transistors 62, 64, 68, 70 and 72. Transistor 62 is biased by a resistor 74 in its emitter circuit with its collector connected to B+. Transistor 64 has a load resistor 75 in its collector circuit with its emitter connected to B−. Similarly, the collector of transistor 68 has a load resistor 76 and its emitter is connected with B−. The collector of transistor 70 is connected to the base of transistor 72 via a Schottky diode 80 and directly to the gate of a MOS-FET transistor 82. The emitter of transistor 70 is connected to B−. Bias is provided to the base of transistor 72 by a resistor 84 and a diode 86 which are connected with B+. Transistor 72 functions as a start-up transistor and is connected in parallel with MOS-FET 82. Specifically, the emitter and collector of transistor 72 are connected with the source and drain, respectively, of MOS-FET 82. The output of circuit 52 is at a terminal 88 which comprises a ground for the various sections on printed circuit board 34 including previously mentioned step-up switching regulator 42. When operating, regulator 42 steps up B+ to approximately 6 volts D.C. on an output line 90 which comprises the positive power supply for the remaining sections on the printed circuit board. The gate of MOS-FET 82 and the collector of transistor 70 are connected by a resistor 92 to the 6 volt output line 90. A resistor 94 is connected between the collectors of transistors 64 and 70. The cathode of temperature sensing diode 54 is connected to B+ while its anode is connected with the base of transistor 62. A capacitor 96 is connected between the emitter of transistor 62 and B− to provide transient suppression.

Having described the components which make up sensing circuit 52, its operation will now be described. Sensing diode 54 provides reverse leakage current to the base junction of transistor 62. It should be mentioned that virtually any silicon diode exhibits reverse leakage current useful in the present invention. In silicon diodes, the reverse leakage current is relatively sensitive to temperature changes in that the leakage current doubles with approximately every 10° C. increase in temperature. Of course, a high temperature rated diode having a maximum operating temperature of at least 150° C. should be used in this application such that it may function at least up to the maximum overall operating temperature of the electronic component assembly. Transistor 62 provides current gain so that the reverse leakage current appears as a proportional voltage on resistor 74. In accordance with the preceding temperature monitoring objectives, the temperature at which sensing circuit 52 shuts down the electronic component assembly is determined by adjusting the value of resistor 74. For example, if resistor 74 is approximately 10K ohms, a shutdown temperature near 80° C. is achieved.

Continuing to refer to FIG. 5, during normal low temperature operation, voltage appearing on resistor 74 is insufficient to turn on transistor 64. Therefore, transistor 68 is on which, consequently, holds transistor 70 in an off state. As a result, MOS-FET 82 is on such that terminal 88 is connected with B− to provide a power return path for regulator 42 and the remaining circuitry on printed circuit board 34. As the sensed temperature rises towards the shutdown temperature (at or slightly below the maximum overall operating temperature of the electronic component assembly), the voltage on resistor 74 correspondingly increases and is coupled to the base of transistor 64. The latter turns on when its base voltage reaches approximately 0.7 volts. The voltage on the collector of transistor 64 is then pulled down such that transistor 68 turns off from its previously saturated state. The collector voltage of transistor 68 then rises and turns on transistor 70 to pull down its collector voltage. This turns MOS-FET 82 and transistor 72 off, disconnecting the B− line from regulator 42 and the remaining circuitry. This condition is maintained by the circuit so long as the sensed temperature remains at or above the shutdown level.

In the event that the temperature drops below the shutdown temperature, the voltage decreases across resistor 74 in direct response to the reverse leakage current from diode 54 to turn off transistor 64 which results in turning on transistor 68. When the latter turns on, its collector voltage falls, causing transistor 70 to turn off. However, at this point, the gate of MOS-FET 82 is biased through resistor 84 from B+. This voltage may not be sufficient to turn on MOS-FET 82, since more than the full potential of battery 60 may be required to do so. Therefore, initial startup is performed by transistor 72. Specifically, transistor 72 is biased such that the rising potential on the collector of transistor 70 turns transistor 72 on to cause step-up regulator 42 to begin operating such that approximately 6 volts D.C. is placed on line 90. The potential on line 90 through resistor 92 then pulls up the gate of MOS-FET 82 to bring the circuit into a fully operational state. The regulator voltage is also fed to the base of transistor 68 through resistor 94 as positive feedback to improve circuit start-up. Because transistor 72 is a bipolar transistor, it may undesirably exhibit a relatively high voltage drop between its collector and emitter in its on or saturated state. Therefore, resistor 92 is used to bias the gate of MOS-FET 82 to turn on the MOS-FET. The latter exhibits a very low voltage drop proportional to drain current in its on state, for example, approximately 100 millivolts. As regulator 42 turns on, the entire electronic component assembly on printed circuit board 34 is powered. The circuit of FIG. 5 advantageously uses four amplification stages (transistors 62, 64, 68 and 70) coupled with positive feedback from resistor 94 to improve start-up and shutdown characteristics of the circuit. Other advantage are realized in using sensor circuit 52 in that the circuit requires low operational power and, consequently, produces insignificant heat during operation.

Still referring to FIG. 5, it should be understood that components used in this circuit should have relatively high maximum operating temperatures since this circuit operates even when the remaining circuitry in the drill head is shut down. However, suitable components are readily available which include specified maximum operating temperatures of 150° C. or more. For example, useful components include the 2N2222A (bipolar transistor), the Siliconix Si9410 (MOS-FET) and the 1N4148 (diode). As an alternative to using a diode and associated circuitry for performing the functions required herein, it should be mentioned that a component such as, for example, a thermal relay may be used.

It should be understood that an arrangement for thermally protecting an electronic component assembly within a boring tool and its associated method may be embodied in many other specific forms and produced by other methods without departing from the spirit or scope of the present invention. For example, the teachings of the present invention may readily be applied in environments other than that of a boring tool for thermally protecting one or more electronic component assemblies. It is also mentioned that the present invention is adaptable for performing temperature monitoring at more than one position in proximity to an electronic component assembly. Therefore, the present examples are to be considered as illustrative and not restrictive, and the invention is not to be limited to the details given herein, but may be modified within the scope of the appended claims.

What is claimed is:

1. In a boring tool including a drill head, a method of thermally protecting to a limited extent an electronic component assembly located in the drill head from heat, said electronic component assembly including a plurality of thermally sensitive electronic devices, each said device being constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage, said method comprising the steps of:

a) providing operational power to said electronic component assembly including said devices;

b) during powered operation of said assembly, sensing the ambient temperature at a predetermined position in close proximity to said devices; and c) disconnecting said operational power from said electronic component assembly when the sensed temperature reaches a predetermined temperature at the sensed position which predetermined temperature is not necessarily equal to a lowest one of said maximum operating temperatures such that said heat may cause the temperature of the electronic component assembly in an unpowered state to continue to rise to a maximum overall non-operating temperature without thermally damaging said devices due to said heat.

2. The method of claim 1 further comprising the steps of (i) continuing to sense the ambient temperature at said predetermined position after the step of disconnecting said operational power and (ii) reconnecting said operational power to said electronic component assembly once the sensed temperature falls below said predetermined temperature.

3. The method of claim 1 wherein said temperature sensing step includes the step of monitoring the reverse leakage current of a diode located at said predetermined position so as to establish the sensed temperature.

4. The method of claim 1 wherein each one of said devices may include a different maximum operating temperature and wherein said disconnecting step disconnects said operational power from the assembly at a temperature corresponding to a lowest one of said different maximum operating temperatures.

5. The method of claim 4 wherein said sensing step senses the ambient temperature at said predetermined position immediately adjacent the device which includes the lowest one of said different maximum operating temperatures.

6. The method of claim 1 wherein said electronic component assembly includes at least one heat generating component which generates a portion of said heat and wherein said sensing step senses the ambient temperature at said predetermined position immediately adjacent a particular one of said electronic devices which particular device is substantially subjected to that portion of said heat generated by said heat generating component.

7. The method of claim 1 wherein a first portion of said heat is conducted to said electronic component assembly from its ambient surroundings and wherein said sensing step senses the ambient temperature at said predetermined position such that the sensed temperature is at least in part attributable to said first portion of heat conducted from the ambient surroundings of the assembly.

8. The method of claim 7 wherein said electronic component assembly includes at least one heat generating component which generates a second portion of said heat and wherein said sensing step senses the ambient temperature at said predetermined position such that the sensed temperature is substantially attributable to a combination of said first and second portions of said heat.

9. The method of claim 1 wherein each electronic device may include a different maximum operating temperature and wherein said disconnecting step disconnects said operational power from the assembly at a sensed temperature corresponding to the maximum operating temperature of a particular one of said devices which sensed temperature is higher than the lowest one of said different maximum operating temperatures.

10. A method of operating a boring tool so as to thermally protect to a limited extent an electronic component assembly, which forms part of the boring tool, from heat, said electronic component assembly including a plurality of thermally sensitive electronic devices, each said device being constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage, said method comprising the steps of:

a) providing operational power to said electronic component assembly including said devices;

b) during powered operation of said assembly, sensing the ambient temperature at a predetermined position in close proximity to said devices; and c) disconnecting said operational power from said electronic component assembly when the sensed temperature reaches a predetermined maximum operating temperature of one of said devices at the sensed position such that said heat may cause the temperature of the assembly to continue to rise in an unpowered state to a maximum overall non-operating temperature without thermally damaging the devices within the assembly due to said heat.

11. The method of claim 10 further comprising the steps of (i) continuing to sense the ambient temperature at said predetermined position after the step of disconnecting said operational power and (ii) reconnecting said operational power to said electronic component assembly once the sensed temperature falls below said predetermined maximum operating temperature.

12. The method of claim 10 wherein each of said thermally sensitive electronic devices may include a different maximum operating temperature and wherein said disconnecting step disconnects said operational power from the assembly at a temperature corresponding to a lowest one of said different maximum operating temperatures.

13. The method of claim 10 including the step of cooling the boring tool in the ground during the preceding steps so as to at least partially remove said heat.

14. The method of claim 13 wherein said cooling step cools the boring tool using fluid and wherein the boiling point of said fluid is between said maximum operating temperature and said maximum non-operating temperature such that at least a portion of said fluid initially carried by the cooling means must enter a vapor phase prior to said electronic component assembly reaching said maximum non-operating temperature.

15. The method of claim 14 wherein said fluid includes water.

16. The method of claim 10 wherein each electronic device may include a different maximum operating temperature and wherein said disconnecting step disconnects said operational power from the assembly at a sensed temperature corresponding to the maximum operating temperature of a particular one of said devices which sensed temperature is higher than the lowest one of said different maximum operating temperatures.

17. In a boring tool including a drill head, a heat protected electronic system, comprising:

a) an electronic component assembly located in said drill head and including a plurality of thermally sensitive electronic devices, each said device being constructed (1) such that when the device is in a powered state there is a maximum operating temperature to which it may be subjected without causing thermal damage and (2) such that when the device is in a non-powered state there is a higher, maximum non-operating temperature to which the device may be subjected without causing thermal damage;

b) means for providing operational power to said devices;

c) sensing means for sensing the ambient temperature at a predetermined position in close proximity to said devices; and d) means for disconnecting said operational power from said assembly including said devices when the sensed temperature reaches a predetermined temperature at the sensed position which predetermined temperature is not necessarily equal to a lowest one of said maximum operating temperatures such that said heat may cause the temperature of the assembly to continue to rise in an unpowered state to a maximum overall non-operating temperature without thermally damaging any of the devices within the assembly due to said heat.

18. The system of claim 17 wherein said sensing means continues to sense the ambient temperature at said predetermined position after said operational power has been disconnected by said disconnecting means and said disconnecting means includes means for reconnecting the operational power to said electronic component assembly once the sensed temperature falls below said predetermined temperature.

19. The system of claim 17 wherein each said electronic device may include a different maximum operating temperature and wherein said disconnecting means disconnects said operational power from the assembly at a sensed temperature corresponding to a lowest one of said different maximum operating temperatures.

20. The system of claim 19 wherein said sensing means senses the ambient temperature at said predetermined position immediately adjacent the device which includes the lowest one of said different maximum operating temperatures.

21. The system of claim 17 wherein said electronic component assembly includes a heat generating component which generates a portion of said heat and wherein said sensing means senses the ambient temperature at said predetermined position immediately adjacent a particular one of said electronic devices which particular device is subjected to that portion of said heat generated by said heat generating component.

22. The system of claim 17 wherein a first portion of said heat is conducted to said electronic component assembly by its surroundings and wherein said sensing means senses the ambient temperature at said predetermined position such that the sensed temperature is at least in part attributable to said first portion of heat conducted from the surroundings of the assembly.

23. The system of claim 22 wherein said electronic component assembly includes at least one heat generating component which generates a second portion of said heat and wherein said sensing means senses the ambient temperature at said predetermined position such that the sensed temperature is substantially attributable to a combination of said first and second portions of said heat.

24. The system of claim 17 wherein said sensing means includes a diode located at said predetermined position and means for monitoring the reverse leakage current of said diode so as to establish the sensed temperature.

25. The system of claim 24 wherein said electronic component assembly includes a plurality of said thermally sensitive electronic devices each of which may include a different maximum operating temperature and wherein said diode includes a maximum operating temperature which is higher than a temperature corresponding to a lowest one of said different maximum operating temperatures of said plurality of devices.

26. The system of claim 17 wherein each electronic device may include a different maximum operating temperature and wherein said disconnecting means disconnects said operational power from the assembly at a sensed temperature corresponding to the maximum operating temperature of a particular one of said devices which temperature is higher than the lowest one of said different maximum operating temperatures.

27. In a system in which a boring tool is moved through the ground, an arrangement for protecting to a limited extent an electronic component assembly from heat, said arrangement forming part of the boring tool and containing a plurality of thermally sensitive electronic devices, each said device being constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage, said arrangement comprising:

a) means for providing operational power to said assembly;

b) sensing means for sensing the temperature at a predetermined position in close proximity to said assembly; and c) means for disconnecting said operational power from said assembly during the powered operation of the assembly when the sensed temperature reaches a predetermined maximum operating temperature of one of said devices at the sensed position such that said heat may cause the temperature of said assembly to continue to rise in an unpowered state to a maximum overall non-operating temperature without thermally damaging said devices within the assembly due to said heat.

28. The arrangement of claim 27 wherein said sensing means continues to sense the temperature at said predetermined position after said operational power has been disconnected by said disconnecting means and said disconnecting means includes means for reconnecting the operational power to said electronic component assembly once the sensed temperature falls below said predetermined maximum operating temperature.

29. The arrangement of claim 27 wherein said boring tool includes a casing in physical contact with the ground and which houses said electronic component assembly such that a first portion of said heat is generated by relative movement between the ground and the casing and is, thereafter, conducted to said electronic component assembly and wherein said sensing means senses the temperature at said predetermined position such that the sensed temperature is at least in part attributable to said first portion of heat conducted from the casing.

30. The arrangement of claim 29 wherein said electronic component assembly includes at least one heat generating component which generates a second portion of said heat and wherein said sensing means senses the temperature at said predetermined position such that the sensed temperature is substantially attributable to a combination of said first and second portions of said heat.

31. The arrangement of claim 27 wherein each electronic device may include a different maximum operating temperature and wherein said disconnecting means disconnects said operational power from the assembly at a sensed temperature corresponding to the maximum operating temperature of a particular one of said devices which sensed temperature is higher than the lowest one of said different maximum operating temperatures.

32. A heat protected boring tool, comprising:

a) a drill head;

b) an electronic component assembly located in said drill head and including a plurality of thermally sensitive electronic devices, each said device being constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage;

c) means for providing operational power to said assembly including said devices;

d) sensing means for sensing the temperature at a predetermined position in close proximity to said devices; and e) means for disconnecting said operational power from said assembly when the sensed temperature reaches a predetermined temperature at the sensed position which predetermined temperature is not necessarily equal to a lowest one of said maximum operating temperatures such that said heat may cause the temperature of said assembly to continue to rise in an unpowered state to a maximum overall non-operating temperature without thermally damaging said devices within said assembly due to said heat.

33. The boring tool of claim 32 wherein said sensing means continues to sense the temperature at said predetermined position after said operational power has been disconnected by said disconnecting means and said disconnecting means includes means for reconnecting the operational power to said electronic component assembly once the sensed temperature falls below said maximum operating temperature.

34. The heat protected boring tool of claim 32 wherein each electronic device may include a different maximum operating temperature and wherein said disconnecting means disconnects said operational power from the assembly at a sensed temperature corresponding to the maximum operating temperature of a particular one of said devices which sensed temperature is higher than the lowest one of said different maximum operating temperatures.

35. A heat protected boring tool, comprising:

a) a drill head;

b) an electronic component assembly located in said drill head including a plurality of thermally sensitive electronic devices, each said device being constructed (1) such that when the device is in a powered state there is a maximum operating temperature to which it may be subjected without causing thermal damage and (2) such that when the device is in a non-powered state there is a higher maximum non-operating temperature to which the device may be subjected without causing thermal damage;

c) means for providing operational power to said assembly including said devices;

d) sensing means for sensing the ambient temperature at a predetermined position in close proximity to said devices;

e) means for disconnecting said operational power from said assembly when the sensed temperature reaches a predetermined maximum operating temperature of one of said devices at the sensed location such that said heat may cause the temperature of said assembly to continue to rise in an unpowered state to a maximum overall non-operating temperature without thermally damaging said devices within said assembly due to said heat; and f) means for cooling the boring tool in the ground so as to at least partially remove said heat such that said cooling means cools the boring tool using a fluid including water and wherein the boiling point of said fluid is between said predetermined maximum operating temperature and said maximum non-operating temperature such that at least a portion of said fluid initially carried by the cooling means must enter a vapor phase prior to said electronic component assembly reaching said maximum non-operating temperature.

36. The boring tool of claim 35 wherein said cooling means cools the boring tool using fluid and wherein the boiling point of said fluid is between said maximum operating temperature and said maximum non-operating temperature such that at least a portion of said fluid initially carried by the cooling means must enter a vapor phase prior to said electronic component assembly reaching said maximum non-operating temperature.

37. The boring tool of claim 36 wherein said fluid includes water.

38. A heat protected boring tool, comprising:

a) a drill head;

b) an electronic component assembly located in said drill head and including a plurality of discrete, thermally sensitive electronic devices, each said device being constructed (1) such that when the device is in a powered state there is a respective maximum operating temperature to which it may be subjected without causing thermal damage and (2) such that when the device is in a non-powered state there is a respective higher maximum non-operating temperature to which the device may be subjected without causing thermal damage, said assembly further including at least one heat generating component which generates a first portion of said heat;

c) a casing for housing said electronic component assembly and being in physical contact with the ground such that a second portion of said heat is generated by relative movement between the ground and the casing and is, thereafter, partially conducted to said electronic component assembly;

d) means for cooling said electronic component assembly using a fluid which includes water to at least partially remove said heat such that the boiling point of said water is between said maximum operating temperature and said maximum non-operating temperature and so that at least a portion of water initially carried by the cooling means must enter its vapor phase prior to said electronic component assembly reaching said maximum non-operating temperature;

e) means for providing operational power to said assembly including said devices;

f) sensing means including a diode located at a predetermined position in close proximity to said devices for sensing the temperature by monitoring the reverse leakage current of said diode such that the sensed temperature is substantially attributable to a combination of said first and second portions of said heat; and g) means for disconnecting said operational power from said assembly when the sensed temperature reaches a lowest one of said maximum operating temperatures for said devices such that said heat may cause the temperature of the assembly to continue to rise in an unpowered state to a maximum overall non-operating temperature without thermally damaging said devices within said electronic component assembly due to said heat.

* * * * *